United States Patent [19]

Chao et al.

[11] 3,937,320

[45] Feb. 10, 1976

[54] LIGHTED JEWELRY BOX

[76] Inventors: Albert L. Chao; Ethel Chao, both of 407 Glendale Road, Northvale, N.J. 07647

[22] Filed: Aug. 12, 1974

[21] Appl. No.: 496,511

[52] U.S. Cl. ..... 206/75; 132/DIG. 2; 206/76; 240/2 AD; 240/6.4 R; 240/DIG. 4

[51] Int. Cl.[2] ..... B65D 1/34; F21V 33/00

[58] Field of Search ..... 206/75–76; 240/2 AD, 6, 6.45 R, 6.45 P, 6.4 R, 6.4 W, 6.4 K, 6.43, DIG. 4; 312/223; 132/DIG. 2

[56] References Cited

UNITED STATES PATENTS

| | | | |
|---|---|---|---|
| 389,640 | 9/1888 | Cox | 240/DIG. 4 |
| 712,112 | 10/1902 | Arnold | 132/DIG. 2 |
| 1,681,755 | 8/1928 | Warner et al. | 206/76 |
| 1,900,467 | 3/1933 | Scruggs | 206/75 |
| 2,159,934 | 5/1939 | Preisz | 240/6.45 R X |
| 2,867,353 | 1/1959 | Botham | 206/75 X |
| 3,182,184 | 5/1965 | Echols et al. | 240/6.45 P |

*Primary Examiner*—William Price
*Assistant Examiner*—Steven E. Lipman
*Attorney, Agent, or Firm*—Richard L. Miller

[57] ABSTRACT

An improved jewelry box which incorporates a light to direct light rays at the jewelry contained therewith when the jewelry box cover is opened up; the device consisting of a miniaturized lamp bulb on the inner side of the cover in electric circuit with a pair of small dry cell batteries contained under the jewelry pad or pillow that is located in the case, and an electric switch located adjacent the hinge about which the cover pivots; the switch automatically closing the circuit when the cover is opened up.

1 Claim, 6 Drawing Figures

LIGHTED JEWELRY BOX

This invention relates generally to jewelry boxes.

A principle object of the present invention is to provide an improved jewelry box which includes a small electric lamp that lights up the jewelry contained therein when the box cover is flipped open, in order that reflecting light rays from the jewelry make it to glow so that the jewelry appears more attractive and appealing.

Another object is to provide a lighted jewelry box which would accordingly be advantageous for use by jewelry retail merchants in order to achieve more sales.

Other objects are to provide a lighted jewelry box that is simple in design, inexpensive to manufacture, rugged in construction, easy to use and efficient in operation.

These and other objects will be readily evident upon a study of the following specification and the accompany drawing wherein.

Figure 1:
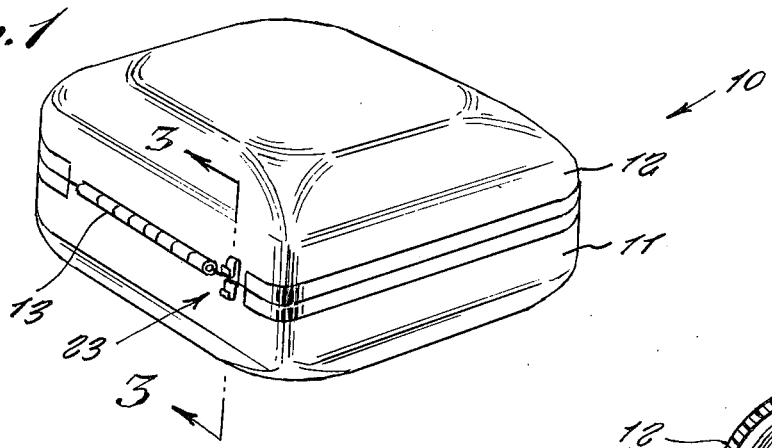
FIG. 1 is a rear perspective view of the lighted jewelry box shown in a closed position.
Figure 2:
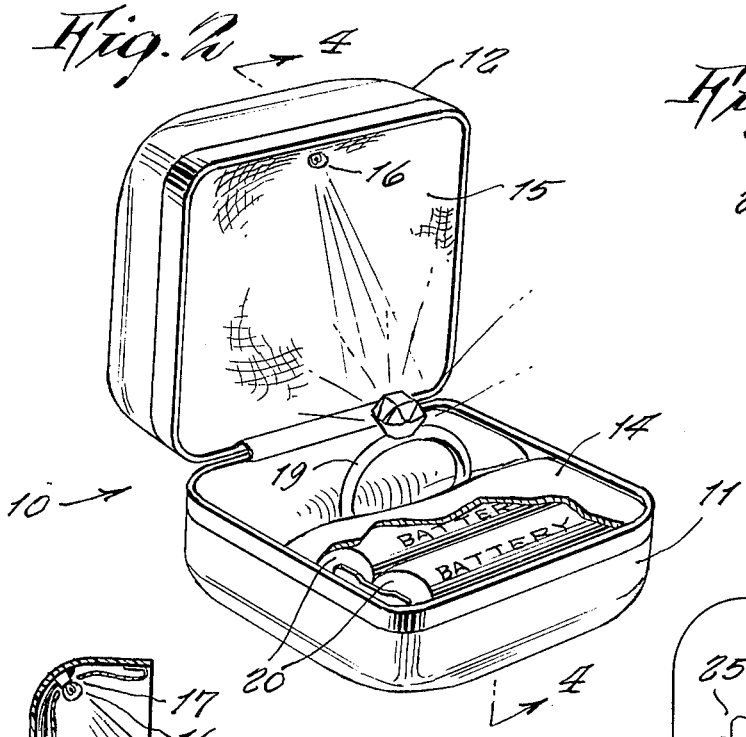
FIG. 2 is a front perspective view thereof shown with cover opened and lamp illuminating a jewelry item; a jewelry pad within the box being illustrated partly broken away so to show batteries therebeneath.

Referring now to the drawing in detail, the reference numeral 10 represents a lighted jewelry box according to the present invention wherein there is a case 11 and cover 12 pivotally attached together by a hinge 13. The interior of the case is fitted with a pad or pillow upon which a jewelry item is placed. Such pad or pillow may simply be a plastic insert 14, as shown in the drawing, and the upper surface of which is coated with imitation felt or velvet so to give a luxuriant support for the jewelry. The interior of the cover is lined with a silk, rayon or other shiny fabric liner 15. The case and cover are usually made of hard plastic material, the outer surface imitating leather.

In the present invention, the above described box additionally includes a miniaturized electric lamp 16 fixedly mounted by suitable adhesive to the inner surface of the cover. A small opening 17 in the liner 15 allows the lamp dome to protrude therethrough, as shown in FIG. 4, in order that it may shine light rays 18 downwardly upon the ring 19 or other jewelry item.

Figure 3:
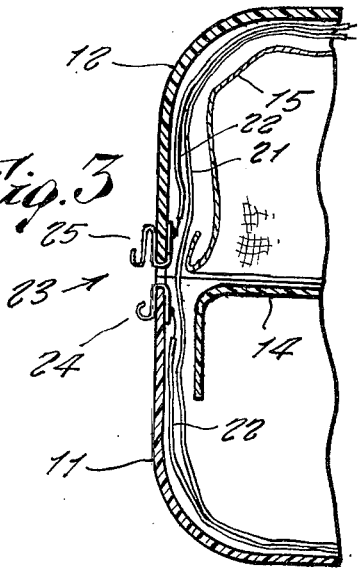
FIG. 3 is an enlarged cross sectional view taken on line 3—3 of FIG. 1 and showing the switch structure.
Figure 6:
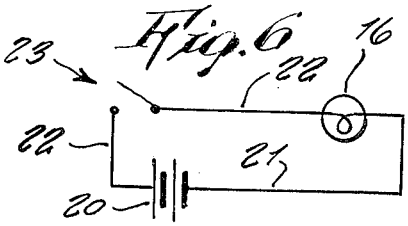
FIG. 6 is an electric circuit of the device.

The lamp 16 is electrically powered by a pair of dry cell batteries 20 that are hidden under the insert 14 and which are connected to the lamp by means of wire conductors 21 and 22. FIGS. 3 and 6 clearly show that the conductor 21 connects directly between the batteries and lamp, whereas conductor 22 is interupted by an electric switch 23 located along the axis of hinge 13.

The switch consists of electrically conductive, U-shaped metal clips 24 and 25 that clip to mating edges 26 and 27 of the case and cover respectively. Each of these edges includes a recessed notch 28 and 29 respectively in which the clips fit in order that they are sufficiently spaced apart, when the box is closed so that they do not make electrical contact with each other.

Figure 4:
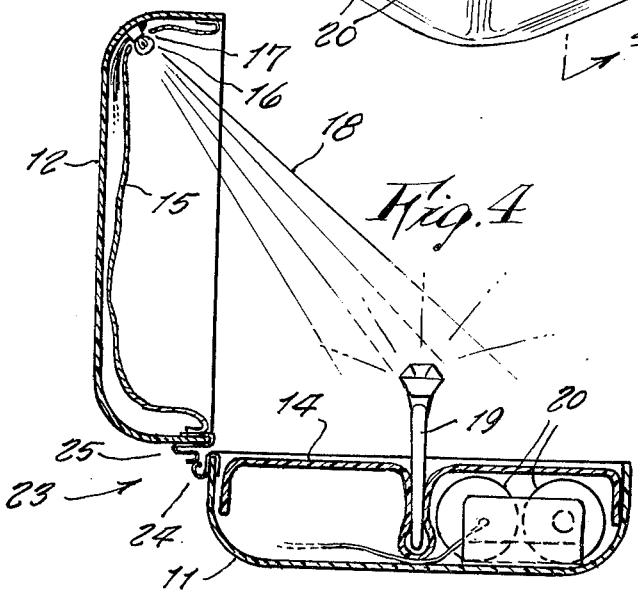
FIG. 4 is a side cross sectional view taken on line 4—4 of FIG. 2 showing the illumination system.
Figure 5:
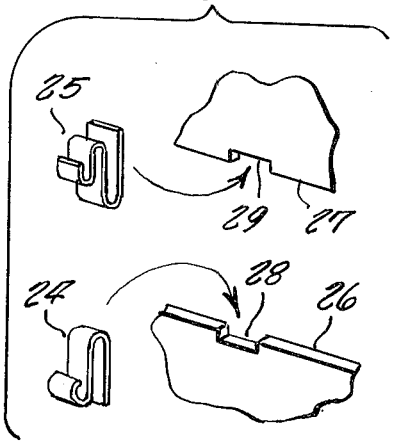
FIG. 5 is a view of details comprising the switch.

In operative use, however, when the cover is pivoted upward the clip is pivoted from the position shown in FIG. 3 to the position shown in FIG. 4, thus closing the electric circuit automatically and lighting the lamp which shines upon the jewelry.

Thus an improved jewelry box is provided.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A lighted box comprising a case, a cover pivotally attached to said case, said case having a rear wall and said cover having a rear wall; hinge means connecting the top of said rear wall of said case with the bottom of said rear wall of said cover with respect to said case; an insert fitted within said case for supporting an item; a fabric lining within an inner side of said cover; and means for illuminating said cover and case, said means comprising an electric circuit having a miniaturized lamp located within said cover, dry cell batteries contained in said case under said insert, and a switch, said switch comprising a first clip having a U-shaped portion of a contact portion, and a second clip having a U-shaped portion and a contact portion, said top edge of said rear wall of said case having a notch formed therein for receiving said U-shaped portion of said first clip, said notch being situated to one side of said hinge means, and said bottom edge of said rear wall of said cover having a notch formed therein for receiving said U-shaped portion of said second clip, said notch of said cover being situated opposite said notch of said case when the cover is pivoted to an open position, said contact portion of said first clip extending rearwardly of said case and said contact portion of said second clip extending rearwardly of said cover, whereby when the cover is pivoted to an open position to allow access to the inside of the box said contacts of said first and second clip abut against each other to close said electric circuit and light said lamp, and when the cover is pivoted to a closed position, the contacts of said first and second clips are moved out of abutting contact to open said electric circuit.

* * * * *